US005641544A

United States Patent [19]

Melancon et al.

[11] Patent Number: 5,641,544

[45] Date of Patent: *Jun. 24, 1997

[54] METHOD AND APPARATUS FOR APPLYING THIN FLUID COATINGS

[75] Inventors: Kurt C. Melancon, Hugo; Carl R. Kessel, St. Paul, both of Minn.; William K. Leonard, Troy Township, St. Croix County, Wis.

[73] Assignee: Minnesota Mining and Manufacturing Company, St. Paul, Minn.

[ * ] Notice: The term of this patent shall not extend beyond the expiration date of Pat. No. 5,505,995.

[21] Appl. No.: 585,264

[22] Filed: Jan. 11, 1996

Related U.S. Application Data

[63] Continuation of Ser. No. 382,962, Feb. 2, 1995, abandoned.

[51] Int. Cl.[6] ..... B05D 3/00; B05C 11/02

[52] U.S. Cl. ..... 427/331; 427/337; 427/348; 427/350; 427/356; 427/358; 427/402; 427/420; 427/428; 118/63; 118/123; 118/126; 118/244; 118/249; 118/324; 118/410; 118/411; 118/DIG. 4

[58] Field of Search ..... 427/350, 348, 427/356, 402, 420, 331, 337, 358, 428; 118/63, 410, 411, 324, DIG. 4, 123, 126, 244, 249

[56] References Cited

U.S. PATENT DOCUMENTS

| | | | |
|---|---|---|---|
| Re. 24,906 | 12/1960 | Ulrich . | |
| 2,135,406 | 11/1938 | MacDonald . | |
| 2,139,628 | 12/1938 | Terry . | |
| 2,761,419 | 9/1956 | Mercier et al. . | |
| 2,761,791 | 9/1956 | Russell . | |
| 3,005,440 | 10/1961 | Padday . | |
| 3,508,947 | 4/1970 | Hughes . | |
| 3,632,378 | 1/1972 | Busch . | |
| 3,632,403 | 1/1972 | Greiller . | |
| 3,916,077 | 10/1975 | Damrau . | |
| 4,093,757 | 6/1978 | Barrand et al. . | |
| 4,348,432 | 9/1982 | Huang . | |
| 4,472,480 | 9/1984 | Olson . | |
| 4,504,645 | 3/1985 | Melancon . | |
| 4,675,208 | 6/1987 | Kageyama et al. | 427/128 |
| 4,748,043 | 5/1988 | Seaver et al. . | |
| 4,978,731 | 12/1990 | Melancon et al. . | |
| 5,234,500 | 8/1993 | Korokeyi . | |
| 5,318,804 | 6/1994 | Yoshida | 427/356 |
| 5,332,797 | 7/1994 | Kessel et al. . | |
| 5,389,150 | 2/1995 | Baum et al. | 118/410 |
| 5,505,995 | 4/1996 | Leonard | 427/402 |

FOREIGN PATENT DOCUMENTS

| | | |
|---|---|---|
| 0 329 802 | 8/1989 | European Pat. Off. . |
| 0 562 975 A2 | 9/1993 | European Pat. Off. . |
| 2-173080 | 7/1990 | Japan . |
| 2-207870 | 8/1990 | Japan . |

*Primary Examiner*—Katherine A. Bareford

*Attorney, Agent, or Firm*—Gary L. Griswold; Walter N. Kirn; Charles D. Levine

[57] ABSTRACT

A system for coating a substrate with an ultra-thin layer includes moving the substrate through a coating station and forming a composite layer including a coming fluid and a carrier fluid. The composite layer flows at a rate that is sufficiently high to form a continuous flowing fluid bridge of composite layer to the substrate surface and to contact the substrate with the flowing composite layer to interpose the coating layer between the substrate and the carrier fluid. The carrier fluid is removed while leaving the coating fluid deposited on the substrate as a coating layer.

34 Claims, 6 Drawing Sheets

METHOD AND APPARATUS FOR APPLYING THIN FLUID COATINGS

This is a continuation of U.S. application Ser. No. 08/382,962 filed Feb. 2, 1995, now abandoned.

TECHNICAL FIELD

The present invention relates to coating. More particularly, the present invention relates to preparing and applying thin and ultra-thin coatings.

BACKGROUND OF THE INVENTION

Coating is the process of replacing the gas contacting a substrate, usually a solid surface such as a web, by a layer of fluid. Sometimes, multiple layers of a coating are applied on top of each other. After the deposition of a coating, it can remain a fluid such as in the application of lubricating oil to metal in metal coil processing or the application of chemical reactants to activate or chemically transform a substrate surface. Alternatively, the coating can be dried if it contains a volatile fluid to leave behind a solid coat such as a paint, or can be cured or in some other way solidified to a functional coating such as a release coating to which a pressure-sensitive adhesive will not aggressively stick. Methods of applying coating are discussed in Cohen, E. D. and Gutoff, E. B., *Modern Coating and Drying Technology*, VCH Publishers, New York 1992 and Satas, D., *Web Processing and Converting Technology and Equipment*, Van Vorstrand Reinhold Publishing Co., New York 1984. It is desired and necessary in many situations to coat ultra-thin layers which are no more than 5 microns thick.

Of the coating methods known for applying continuous fluid coatings (such as roll, curtain, slot, air knife, slide, and gravure coating) other than water expansion techniques, none can apply wet coating thicknesses below about 0.1 micron. To achieve lower final dry thicknesses with these methods, the coating must be diluted with a solvent that can be removed by evaporation to leave behind the desired coating below about 0.1 micron. This increases costs by adding the cost of the diluent, the cost of preparing the diluted coating fluid, and the cost of removing the diluent (such as by drying). Also, the necessary solvent is often hazardous to the environment and the manufacturing personnel.

Discontinuous methods of applying ultra-thin coatings molecule by molecule or drop by drop include condensing from a vapor phase and the electrospray process described in U.S. Pat. No. 4,748,043. However, few fluid coatings of commercial interest can be successfully vaporized, and the electrospray process is limited to a narrow range of viscosity and electrical properties of the coating fluid.

For thicknesses greater than 0.1 micron, multiple roll or transfer roll coaters are used. Typical commercial equipment includes the five roll coater sold by the Bachofen & Meier AG, of Bulach, Germany, and others. This coater style is expensive to purchase and maintain because of its many driven rolls. Any defect in the surface of the rolls usually produces a repeating defect in the coating. Additionally, these coaters have not successfully applied wet coatings in the 0.005 to 0.1 micron range.

Water expansion techniques first started with the Langmuir-Blodgett method of producing and depositing monomolecular films as described by Blodgett in the *Journal of the American Chemical Society* (Vol. 57, 1007, 1935). This method involves casting a dilute solvent solution of a film-forming organic molecule on a stagnant water surface.

The solution spreads to form a thin film on the water-air interface. The solvent is evaporated leaving behind a monolayer of film forming molecules. The film is then deposited on the surface of a substrate by passing the substrate through the water surface on which the monomolecular layer film is riding. U.S. Pat. No. 4,093,757 discloses forming a continuous monomolecular deposit on a continuous substrate. Japanese Patent Application 63-327260 discloses an improvement of the Langmuir-Blodgett monomolecular technology where films greater than a monomolecular layer thick are deposited on a continuous substrate to form an ultra-thin film coating at thicknesses of 0.005 to 5 microns.

Although the water surface expansion technique can coat useful coatings on substrates, it requires that the coating fluid spontaneously and rapidly spread on the water-air interface. To achieve this for many coating formulations, additional solvents or surface active agents must be found and added. Additionally, the maximum coating rate is limited by the rate of spreading. Also, the speed of coating the substrate is limited by other problems. It is reported that at modest speeds of 10 to 50 m/minute, air bubbles tend to be trapped between the film and the substrate. Water expansion techniques rely on picking the coating from a stagnant water pond by passing the substrate through the water surface or contacting the substrate to the water surface. Often, evaporation of solvent must occur to create a solid or near solid surface film to allow the direct transfer of the coating to the substrate. The surface of the pond is also subject to contamination that can increase with time, degrading the coating quality. The water expansion technique is not known to be useable with miscible coating fluids and water soluble or dispersible coating constituents.

SUMMARY OF THE INVENTION

The apparatus and method of this invention coats ultra-thin liquid films onto substrates. The invention includes moving the substrate along a path through a coating station, forming a plurality of flowing layers of fluid, and flowing the layers in contact with each other to form a composite layer. The composite layer includes a coating fluid and a carrier fluid. The composite layer flows at a rate that is sufficiently high to form a continuous flowing fluid bridge of composite layer to the substrate surface for the coating width. The flowing composite layer contacts the substrate to interpose the coating layer between the substrate and the carrier fluid. The carrier fluid is at least partly removed mechanically while leaving the coating fluid on the substrate as a coating layer. Coatings with wet calipers exceeding the ultra-thin range may also be applied using this invention. Miscible and immiscible combinations of coating and carrier fluids may be used in the composite layer.

The substrate passes through the coating station at speeds up to 2000 m/minute. The forming step can use a slide coater, a curtain coater, an extrusion coater, a slot coater, a knife coater, a jet coater, a roll coater, or other coaters, many of which are described in Cohen and Gutoff. The carrier fluid can be removed by doctoring, suction, draining by gravity, blowing, centrifugal removal, evaporation, using electric or magnetic fields, solidification or gelling of coating or carrier followed by mechanical removal, absorption, chemical bonding of the coating followed by mechanical removal of carrier, or combining any of these methods. Additionally, the composite layer can be deposited on a transfer surface, such as a roll or a belt, before contacting the substrate. The carrier fluid can be removed from the transfer surface and so that only the coating fluid is transferred to the substrate from the transfer surface.

DETAILED DESCRIPTION

In this invention, a flowing composite layer fluid stream of carrier fluid and coating fluid is created and deposited on the surface of a substrate such as a web. Deposition occurs as the web moves through the coating station such that the fluid composite layer first contacts the web surface with carrier fluid at the air interface on the web and coating fluid between the web and the carrier fluid. The carrier fluid is removed to leave a thin or ultra-thin coating fluid layer.

The substrate can be any substrate such as a continuous web, discrete sheets or rigid piece parts, or an array of pieces or parts transported through the coating station. The coating fluid can be coated at mean thicknesses that are ultra-thin ranging from 0.005 to 5 microns. Additionally, fluids can be coated onto substrates at thicknesses greater than the ultra-thin range including 100 microns or more.

Figure 1:
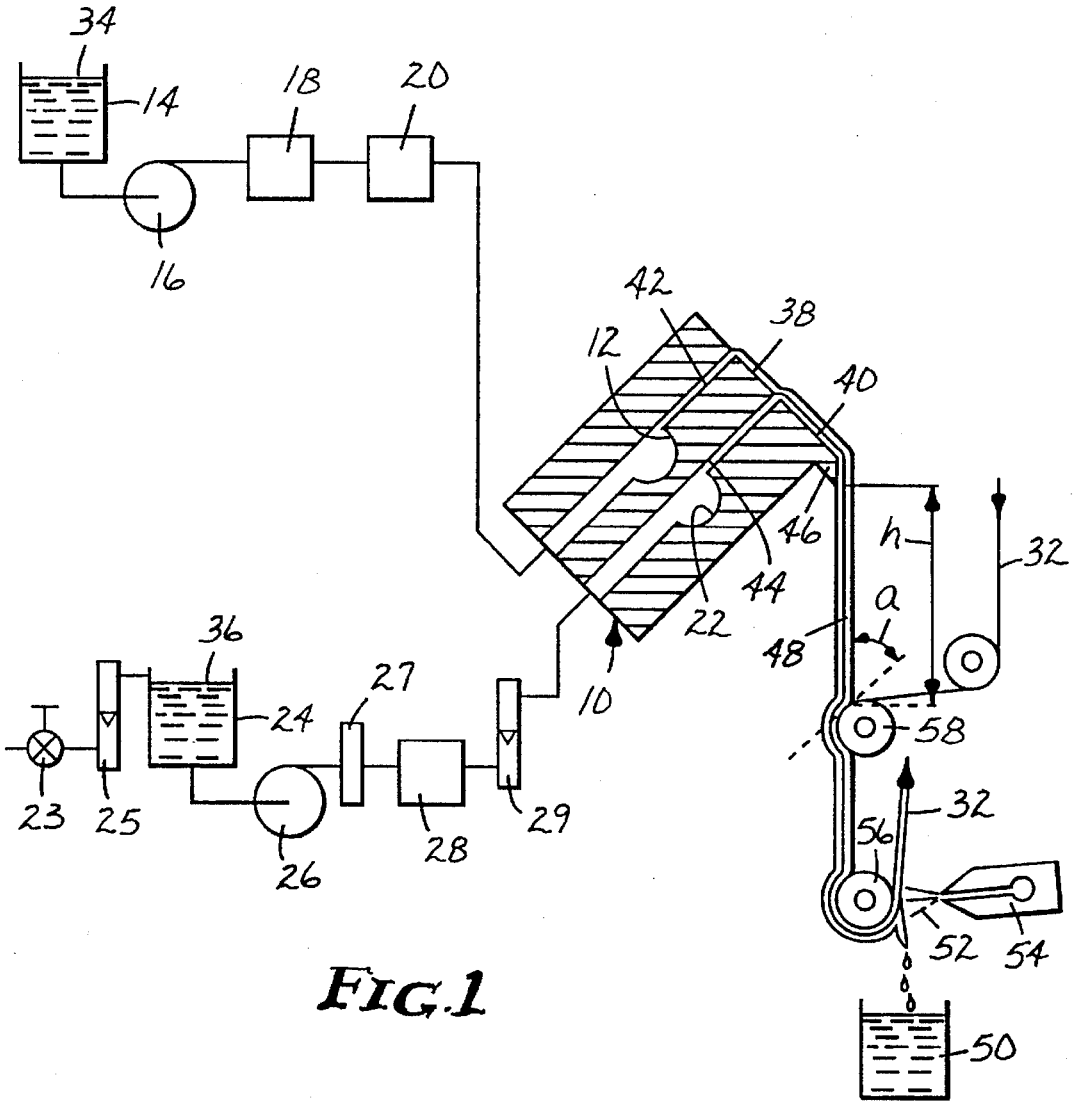
FIG. 1 is a schematic view of a slide curtain coating apparatus according to the present invention.

FIG. 1 shows a coating station having an apparatus for coating at speeds of 1 to 2000 m/minute. A coating die 10, shown as a photographic slide curtain coater, has an internal cavity 12. The internal cavity 12 is connected to a tank 14 by a precision metering pump 16 through a filter 18 and a bubble trap 20. The die 10 also has an internal cavity 22 which is connected to a sealed vacuum tank 24 by a precision metering pump 26 through a surge tank 27, a filter 28, and a flowmeter 29. A coating station is located next to the die 10. A continuous web 32 passes through the coating station and past the die 10 which is mounted transverse to the web.

Coating fluid 34 is pumped at a precisely controlled rate from the tank 14 by the precision metering pump 16 through the filter 18 and the bubble trap 20 into the internal cavity 12 of the coating die 10. Carrier fluid 36 is pumped at a controlled rate from the tank 24 by the metering pump 26 through the surge tank 27, the filter 28, and the flow meter 29 into the internal cavity 22 of the coating die 10. Carrier fluid is continuously added to the vacuum tank 24 through a flow control valve 23 and flow meter 25 from a source (not shown). The tank 24 is connected to a vacuum source which is not shown. For ultra-thin coatings, the flow rate of the carrier fluid is much greater than that of the coating fluid.

The internal cavities 12 and 22 distribute the coating fluid 34 and carrier fluid 36 across the width of the die 10 and to the die faces 38, 40 by distribution slots 42, 44. The composite layer is formed by continuously metering the respective fluids through respective orifices of the slots. The coating fluid 34 flows onto the top of the carrier fluid 36 at the exit of the slot 44, and then flows on top of the carrier fluid, in face-to-face contact, down the inclined die face 40 to the die lip 46. From the lip 46, the composite layer film falls in a curtain 48 under the influence of gravity to contact the web 32. The web 32 is moved through the coating station and past the die 10 so that when the multiple layer curtain 48 contacts the web 32 the coating fluid is adjacent the web surface and is interposed between the web and the carrier fluid. The coating fluid 34 contacts the web. At the point of contact, a composite layer of coating fluid and carrier fluid has been applied to the web.

The composite layer flows at a rate that is sufficiently high to form a flowing, uninterrupted fluid bridge of composite layer from the die lip 46 to the web surface for the coating width. The flow rate of the coating fluid alone need not be sufficient to form a continuous flowing fluid bridge. Regardless of whether the coating fluid is continuous, the carrier fluid must be continuous. The fluid bridge has two distinct fluid-gas interfaces: the coating fluid-air interface and the carrier fluid-air interface. Gases other than air can be used as long as they do not interfere with the coating process.

The carrier fluid is a distinct composition that differs from the coating fluid. The carrier fluid functions to form a bridge between the die and the web upon which the coating fluid can travel to transport the coating fluid to the web and to facilitate the creation of a thin layer of coating fluid before the coating fluid contacts the web. It can contain components that diffuse into the coating fluid or solid materials that by some mechanism are left on the coating fluid after the carrier fluid has been removed from the web. The carrier fluid can be tap water or other fluids. The properties of the coating fluid and the carrier fluid cause the coating fluid flowing onto the carrier fluid to form a continuous surface film, where desired, before reaching the web. After the carrier fluid transports the coating fluid to the web and after the composite layer is deposited on the web, the carrier fluid is removed. All of the carrier fluid need not be removed as long as what remains does not impair the desired characteristics of the coated web.

To achieve good coating uniformity on the web, the carrier fluid flow rate, the curtain height "h", and the curtain angle of impingement "a" with the web are selected and adjusted as the web speed is charged. The curtain height "h" is the distance between the die lip 46 and the web 32 along the path of the carrier fluid curtain 48. This path need not be vertical. Under the influence of surface tension forces, electrostatic forces, viscous traction forces, or magnetic forces, the path can be curved or at an angle near horizontal, especially when the gap from the die to the web is small. At very low speeds, it is often necessary to use a small curtain height (less than 1 cm), an impingement angle near zero, and a minimum carrier flow rate to maintain a continuous, disturbance-free curtain 48 between the lip 46 and the web 32. The curtain 48 must contact the web so that the coating fluid assumes the web velocity, and the coating fluid is acquired by and carried along with the web. Excessively large carrier flow rates, impingement angles, or impingement velocities can cause instability of the fluid bridge when it contacts the web. This can disrupt the coating, or entrain or emulsify the coating fluid in the carrier fluid.

The removal of all or a portion of the carrier fluid from the web 32 without objectionable removal of the coating fluid is possible if at least one of the following physical and chemical property conditions are met: (a) the carrier fluid is substantially more volatile than the coating fluid and can be evaporated leaving behind the coating; (b) the carrier fluid has a substantially lower viscosity than the coating fluid; (c) the carrier fluid does not wet the coating fluid-covered web; (d) the coating fluid preferentially reacts with or is absorbed by the substrate; (e) either coating or carrier are gelled or solidified at the coating station; and (f) the carrier fluid can be absorbed and removed by contacting with an absorbing medium. If the carrier fluid is (g) not miscible with the coating fluid, removal of the carrier fluid is often easier.

A number of alternative mechanical methods of removal of at least some portion of the carrier fluid are possible. If conditions (b), (c), or (d) are met, at low web speeds most of the carrier fluid can be drained under the influence of gravity into a receptacle 50 while the coating fluid remains on and is carried away with the web. Gravity drainage is especially effective at low speeds if conditions (b), (c), and (g) are met. At higher speeds, a gas doctor nozzle, such as an air doctor nozzle 54 as shown in FIG. 1, can supplement gravity drainage. A jet of gas 52 issues from the nozzle 54 creating pressure and shear to force the carrier fluid off the web. At high speeds, the carrier fluid can also be thrown off by centrifugal force when the web rapidly changes direction when turning around a small diameter roll.

Surprisingly, especially when the coating fluid on the web is less than 10 microns thick, and condition (b) is met, mechanical doctors (not shown), such as blades, can remove the majority of the carrier fluid leaving the majority, often all, of the coating fluid on the web.

In one example, the coating fluid is deposited as a layer at least 100 times thinner than the carrier fluid; the coating layer has a viscosity at least ten times higher than the carrier layer; the coating fluid has a vapor pressure less than half that of the carrier layer; the coating layer has interfacial properties such that it does not de-wet from the web while traveling through the coating station; the carrier fluid has interfacial properties such that it does de-wet from the coating fluid-wet web; and the interfacial tension between the carrier fluid and the coating fluid is greater than 1 dyne/cm.

Another unexpected feature of this invention is that if the carrier and coating fluids are immiscible and the viscosity of the coating fluid is higher than that of the carrier fluid, the flow of the carrier fluid can be allowed to become turbulent. Previously, it has always been taught that for the simultaneous unmixed application of multiple fluid layers to a web, both layers must be kept in laminar flow in their respective slots 42 and 44, and in flow down the die face 40. The flow down an incline is transitional if the Reynolds Number, Re, is greater than 1000 and is laminar if the number is less than 1000. For flow down an incline of a Newtonian, non-shear thinning fluid, the Reynolds Number is given by $Re=4G/m$ where G is the mass flow rate per unit width of incline and m is the viscosity of the fluid. For flow in a slot, the Reynolds Number should be kept below 1400 to remain laminar. For slots 42, 44, the Reynolds Number is defined by the equation $Re=G/m$. Still another unexpected feature is that thin coatings may be obtained of miscible coating and carrier fluids. In this case, the mechanical removal of at least some portion of the carrier fluid is produced by drainage or by blowing it off with the gas doctor nozzle 54.

The coating fluid 34 is metered at a controlled volumetric flow rate to the die 10 by the metering pump 16. The mean thickness of the wet coating on the web 32 will approximately equal the volume of coating fluid delivered per unit time divided by the surface area of web upon which it is spread. When coating a continuous web, this area will equal the coated width of the web multiplied by the web speed. This enables easy adjustment of the applied coating deposition rate. It can be changed proportionally by changing the coating pumping rate or inversely proportionally by changing the web speed. If the web speed varies with time, the coating deposited can be kept constant by varying the coating flow rate in proportion to the web speed.

Figure 2:
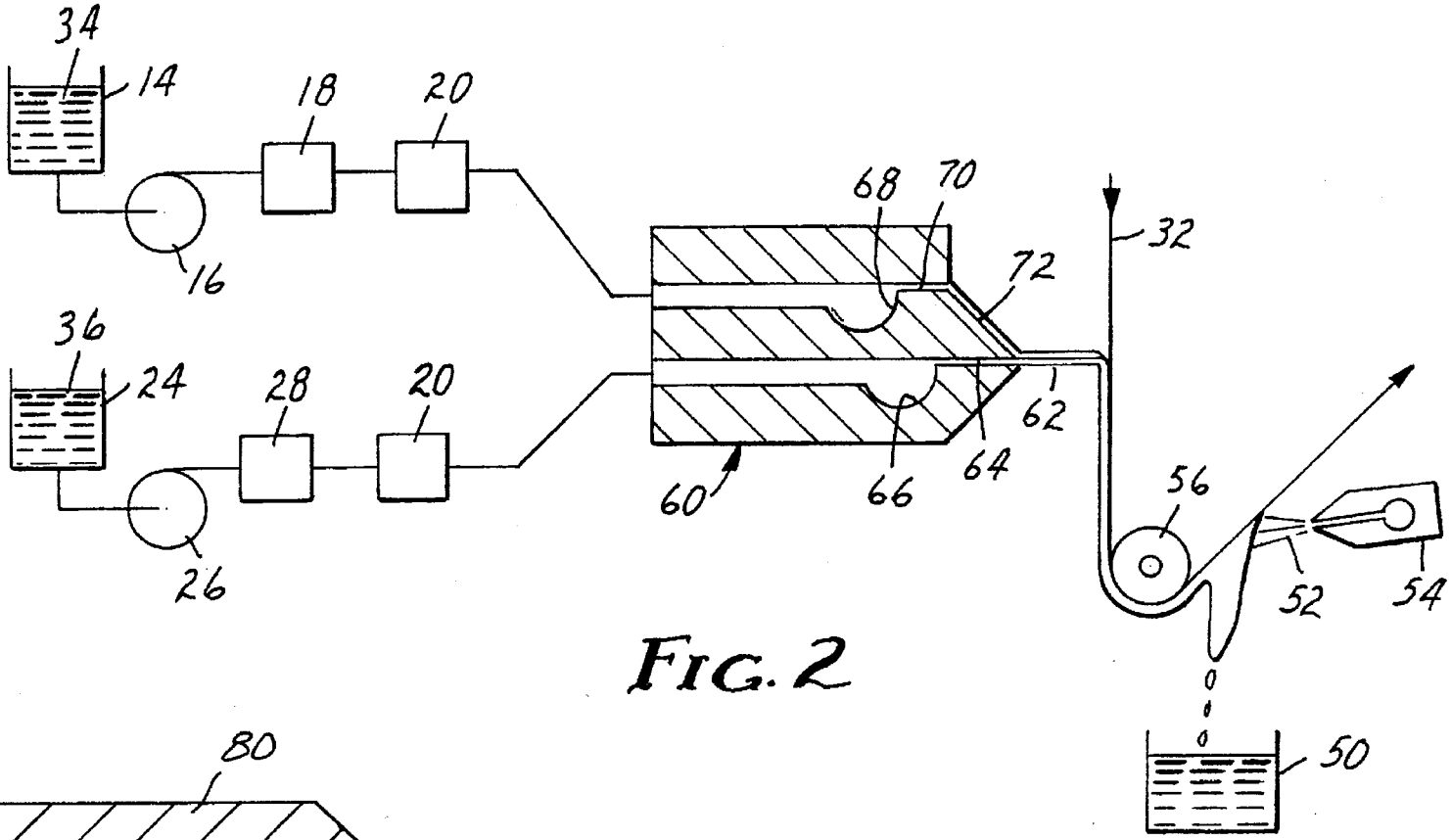
FIG. 2 is a schematic view of a jet coating apparatus according to another embodiment of the present invention.

FIG. 2 shows an alternative coating die useful for coating at varying speeds and preferably above 200 m/min. The die 60 is a multiple layer jet coater. The die 60 ejects a free flowing jet of fluid 62 from the die slot 64, which receives carrier fluid 36 from the cavity 66. The coating fluid 34 issues from a cavity 68 and a slot 70, and slides along inclined die face 72 until it resides on the jet of carrier fluid 36 emanating from the slot 64. The composite jet 62 of two layers is formed at the exit of the slot 64.

A jet coater creates a free flowing jet of fluid 62 that issues from the die slot 64 at a sufficiently high velocity to form the jet 62 without the aid of gravity. In contrast, curtain coaters use gravity to allow the curtain 48 to break free from the coating die lip 46. With a jet coater, the fluid carrier bridge or jet 62 can be created horizontally or vertically upward. Jet coaters have been used in the coating industry to apply only single layers and more commonly to apply a flooding of coating to a web before metering by a roll gap or a blade of a blade coater as is shown in the "Black Clawson Convening Machinery and Systems" brochure #23-CM, p. 4, by the Black Clawson Company of New York, N.Y. Jet coaters have not been used for simultaneous multiple layer application of fluids to produce multiple layers of fluid on a web.

Figure 3:
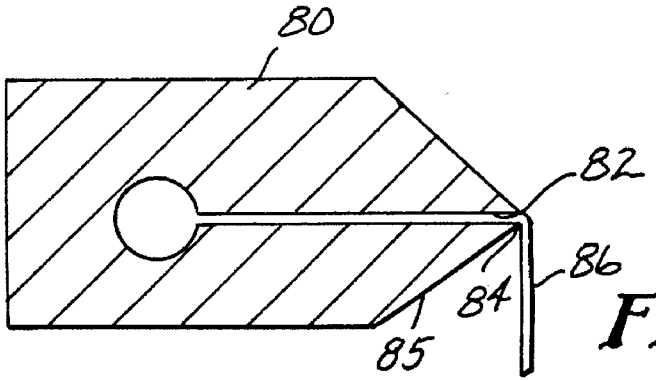
FIG. 3 is a schematic view of a known slot die coating apparatus.

Jet coaters, described in U.S. Pat. No. 5,525,376, entitled "Multiple Layer Coating Method," are distinguished from slot or extrusion coaters in the following ways. First, in jet coaters, the gap between the coater lips and the web is usually greater than ten times the thickness of the fluid layer applied to the web. The second difference is illustrated by comparing the die 60 of FIG. 2 with the die 80 of FIG. 3. FIG. 3 shows how fluid flows from a slot die when not in close proximity to the web. The slot die 80 has an internal geometry and lip geometry that can be used for slot or extrusion coating. It is usually positioned so that the die slot 82 is horizontal. Thus, the coating fluid 86 issuing from the die slot 82 will flow vertically from the die lip 84 as shown if the web is far away from the die. Sometimes, the fluid will run down the face 85 before breaking free from the die body. With a jet coater the fluid will jet from the die lips with a velocity great enough to form a fluid sheet with a top and bottom free surface immediately upon exiting the die slot. A distinguishing feature of the jet coating method is that it can apply fluid to a web at some modest distance from the die lips relative to the thickness of the fluid jet sheet thickness. Importantly the flow is great enough to break free from the die lips unaided by any other forces (such as gravity, magnetic, and electrostatic) and form a free sheet that moves for a measurable distance horizontally away from the lips.

To apply ultra-thin coatings with a jet coater, a coating fluid is metered to the die 60 and flows from the slot 70 down the die face 72 and onto the carrier fluid 36 jetting from the slot 64 to form a composite layer free jet 62. The jet forms a fluid bridge between the die and the web. The angle of impingement of the jet 62 with the web 32, the carrier fluid flow rate, and the web speed are adjusted such that the coating fluid first contacts the web 32 and is carried along with the web without entraining a detrimental amount of air between the coating fluid and the web and without mixing the coating fluid with the carrier fluid.

Figure 4:
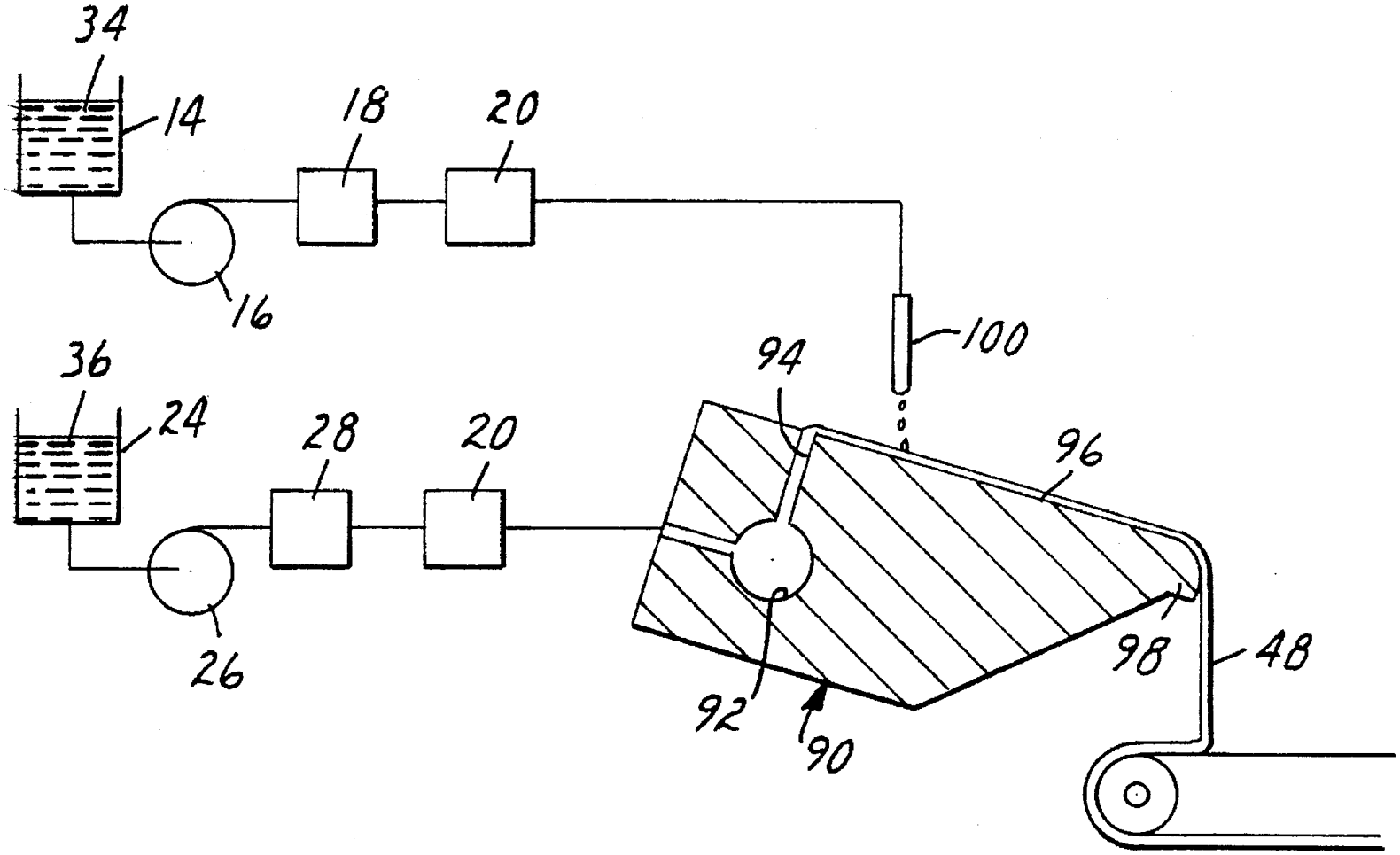
FIG. 4 is a schematic view of a simplified curtain coating apparatus according to another embodiment of the present invention.

If an ultra-thin coating is preformed of a coating fluid that spontaneously and rapidly spreads on the free surface of a carrier fluid, the apparatus shown in FIG. 4 can be used. With this apparatus, a flat expanse of flowing carrier fluid is created by pumping carrier fluid 36 to the die cavity 92 of a die 90, through the die slot 94, and onto the die face 96. The die face 96 and lip 98 are designed to cause the carrier fluid 36 to flow under the influence of gravity to the die lip 98 from which it falls as a bridging curtain 48 onto the web 32. The coating fluid 34 is deposited drop by drop or as a continuous stream onto the carrier fluid 36 surface by a nozzle 100. The rate of flow of the carrier fluid and the time of travel to the lip from which the carrier bridges to the moving web surface must be sufficient to achieve the desired coverage.

Figure 5:
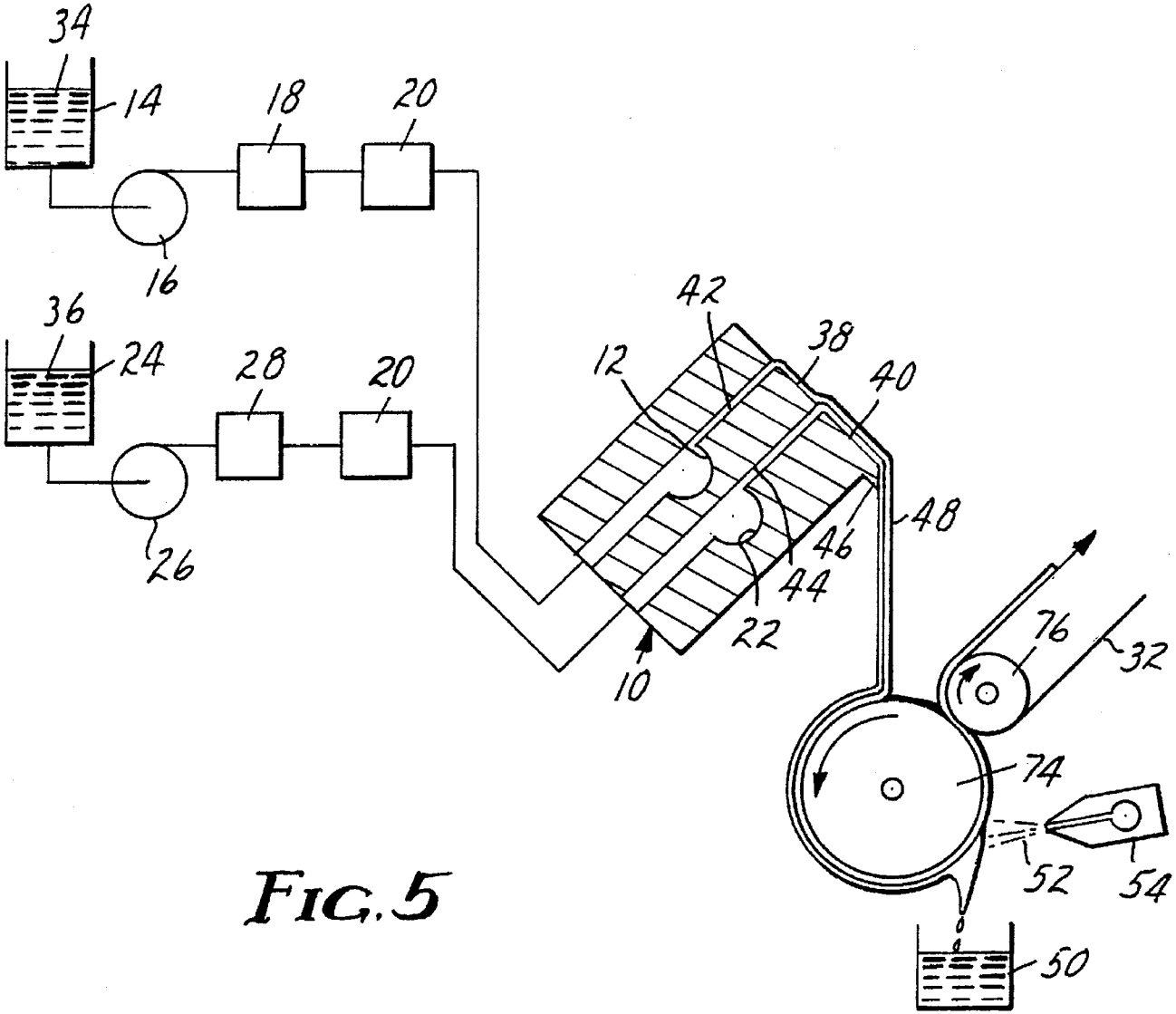
FIG. 5 is a schematic view of another embodiment of the present invention using a transfer roll where the carrier fluid is removed before the transfer of the coating fluid to the web.

Many different devices can be used to form the composite layer. A slide coating apparatus, a curtain coating apparatus, an extrusion coating apparatus, a slot coating apparatus, a jet coating apparatus, or a roll coating apparatus can be used. Additionally, the composite layer can be deposited on a transfer surface, such as a roll or a belt, before contacting the web, as shown in FIG. 5. The carrier fluid 36 is removed from the transfer roll 74 and the coating fluid is transferred to the web 32 from the transfer roll. This is accomplished by supporting the web 32 on the roller 76 which forms a nip with the transfer roll 74. Some portion of the coating can remain on the roll 74 surface after transfer to the web at the nip between the rolls 76, 74.

Figure 6:
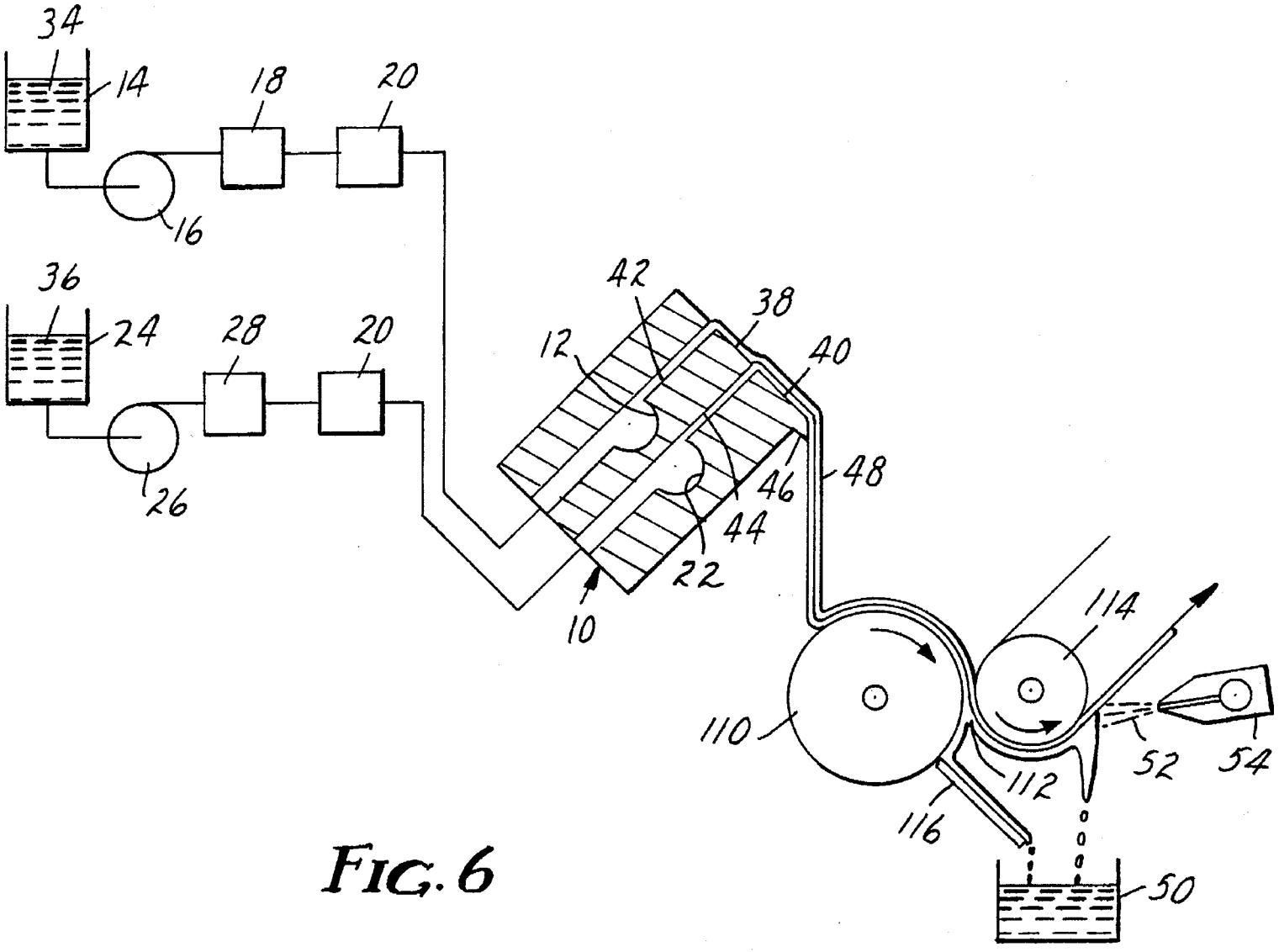
FIG. 6 is a schematic view of another embodiment of the present invention using a transfer roll to carry the carrier and coating fluids to the web.

Another variation of this coating method is shown in FIG. 6. The composite layer is formed on the die 10 and a liquid curtain 48 is formed from the die to a transfer roll 110. A precision gap 112 is maintained between the transfer roll 116 and a web transport roll 114, which rotate in opposite directions. The gap 112 is adjusted so that a second liquid curtain forms in it while allowing all of the composite layer on the transfer roll 110 to pass through the gap 112. The web 32 is also carried through the gap 112 on the surface of the roll 114, and the liquid curtain contacts it so that the coating fluid 34 is interposed between the web surface and the carrier fluid 36. As the composite layer exits from the gap 112, a portion of the carrier fluid may remain on the surface of the transfer roll 110. It is removed from the transfer roll surface by a doctor blade 116 and drains into the receptacle 50. The remaining portion of the carrier fluid 36 stays on the coating fluid wet web surface and is removed by the action of the air doctor nozzle 54 draining by gravity into the receptacle 50.

Figure 7:
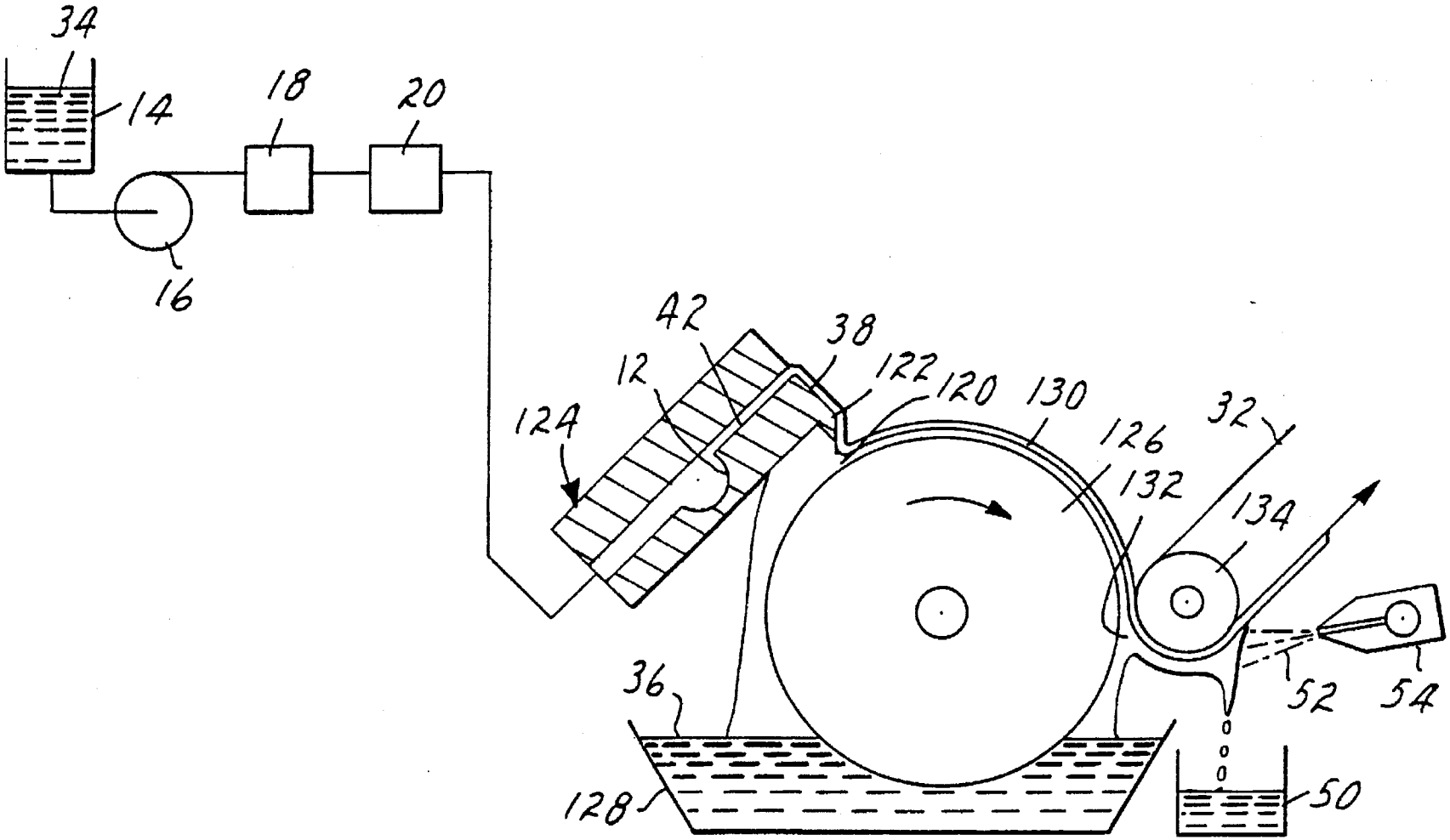
FIG. 7 is a schematic view of another embodiment of the present invention using a knife over roll device combined with a die applicator of the coating fluid.

Another version of the apparatus of FIG. 6 is shown in FIG. 7. The metered layer of carrier fluid 36 is created at a precision orifice 120 between the lip 122 of a die 124 and the surface of a transfer roll 126. The transfer roll 126 rotates through carrier fluid 36, contained by a pan 128, bringing an excess to the gap 120. The coating fluid 34 is pumped to the die cavity 12 and exits from the slot 42 through an orifice onto the die face 38. It flows down the lip 122 and onto the carrier fluid 36 as it exits the gap 120 to form a flowing composite layer 130 on the transfer roll 126. A precision gap 132 is maintained between the transfer roll 126 and the web transport roll 134 which rotate in opposite directions. The gap 132 is adjusted so that a liquid curtain forms in it while allowing all of the composite layer 130 on the transfer roll 126 to pass through the gap 132. The web 32 is also carried through the gap 132 on the surface of the web transport roll 134, and the liquid curtain contacts it so that the coating fluid 34 is interposed between the web surface and the carrier fluid 36. As the composite layer 130 exits from the gap 132, some of the carrier fluid may remain on the surface of the transfer roll 126 and drain back into the pan 128. The remaining carrier fluid stays on the coating fluid wet web surface and is removed by the air doctor nozzle 54, draining by gravity into the receptacle 50.

The coating fluid should have a combination of interfacial properties and viscosity so that it will not de-wet from the web surface after being spread over the surface during transport through the coating station. Examples of coating fluids coatable by this invention are monomers, oligomers, solutions of dissolved solids, solid-fluid dispersions, fluid mixtures, and emulsions. Such fluids are useful in producing a wide range of functional coatings on webs including release coatings, low adhesion coatings, priming layers, adhesive coatings responsive to electromagnetic radiation or electric or magnetic fields, protective coatings, optically active coatings, and chemically active coatings. Coatings made by this invention are expected to have utility in manufacturing products such as pressure-sensitive adhesive tapes, photographic films, magnetic recording tapes, gas separation membranes, reflective sheeting and signing, medical dressings, coated abrasives, printing plates, and films.

This invention differs from surface expansion methods in that surface expansion techniques require an immiscible coating fluid or a fluid containing some insoluble components to spontaneously, rapidly spread over a near stagnant pool of water to create ultra-thin films of coating. The inventors have discovered that the coating fluids, both miscible and immiscible, can flow onto the surface of a moving carrier fluid as an ultra-thin or thin fluid layer. This enhances the range of fluid coatings that can be coated. Also, in this invention, the entire composite layer forms a flowing liquid bridge and is transferred to the web surface; then the carrier fluid is removed.

This invention makes possible high coating speeds in excess of 500 meters per minute. Known expansion techniques are limited to less than 50 meters per minute, an order of magnitude less than this invention. With expansion techniques, the coating fluid is deposited onto the web directly from the surface of a liquid tank filled with water. This water is a fixed volume, relatively stagnant pool. Contamination of the water with the expansion method is always a risk. With this invention, the continuous flow of carrier fluid helps avoid this problem. Also, with expansion techniques, a solid or near solid film must be formed on the water surface to allow pickup of the coating by the substrate.

This invention differs from known slide and curtain methods as follows. The coating fluid and the carrier fluid flow together to form a stable, flowing composite layer with a free fluid-air surface. This layer can be simultaneously applied to a moving object by forming a fluid bridge to the object made up of a plurality of distinct layers even when the fluids are not miscible. The photographic and graphic arts use simultaneous multiple layer coating techniques but not carrier layers that are removed at the coating station. Additionally, the literature teaches that the fluid solvents in the formulation of these layers should be miscible. Indeed they are normally the same solvent, commonly water.

The literature teaches that the interfacial tension between the layered fluids be very low, preferably zero, and the surface tension of adjacent layers should be only slightly different. With this invention, the interfacial tension between the carrier and the coating is preferred to be as high as possible, and the surface tensions are preferred to differ widely to facilitate carrier removal.

When multiple layer slide or curtain coating is used, the literature teaches that all layers flow in a laminar, streamlined manner to maintain the layered structure and to avoid mixing the layers. With this invention, the fluids can remain unmixed even if the carrier fluid becomes turbulent.

When multiple layer slide, curtain, or slot coating methods are used, the literature teaches that the ratio of thickness of top-to-bottom adjacent fluid layers be no larger than 100 to 1 and no single layer be thinner than 0.1 micron. This invention uses ratios of up to 100,000 to 1 and single layer thicknesses as thin as 0.005 micron. Known slide, curtain, and slot coating methods can not coat a single or multiple layer coating which has a total wet thickness of 5 microns or less. This invention can produce single layer coatings of 0.005 to 100 microns.

When the known multilayer slide and curtain coating methods are practiced, a composite layer is created and deposited on the web followed by a solidification, gelling or drying process. All layers in the composite remain together on the web as it passes out of the coating station. Nothing is removed. In this invention, carrier fluid of the composite is removed by some mechanical means after deposition of the composite on the web and before leaving the coating station.

The invention is further illustrated by the following examples.

EXAMPLE 1

Ultra-thin Coating of an Immiscible Fluid

Using the slide curtain coating die shown in FIG. 1 an ultra-thin coating of a synthetic oil was applied to a polyester web. The coating fluid was Mobil 1™, 5W-30 motor oil manufactured by the Mobil Oil Corporation of New York, N.Y. Its measured viscosity was 102 cp at its supply temperature of 25° C. The polyester web was 15.2 cm (6 inch) wide, 35.6 micron (1.4 mil), Scotchpar™ polyester film purchased from Minnesota Mining and Manufacturing Company of St. Paul, Minn. The carrier fluid used was tap water from the municipal water supply without any surface tension modifying additives. The water was supplied at a temperature of 18.3° C. to a vacuum degassing vessel operated at pressure of 115 mm of Hg absolute.

The carrier water flow rate was measured both entering and leaving the vacuum degassing vessel with two identical rotometers. These were model 1307EJ27CJ1AA, 0.2 to 2.59 gpm meters purchased from the Brooks Instrument Corporation of Hatfield, Pa. The flow from the vessel was pumped by a progressive cavity pump model 2L3SSQ-AAA, Moyno™ pump of the Robbins & Meyers Corporation of Springfield, Ohio. To obtain a vacuum seal through this pump, it was run reverse of its normal operation. That is, its rotor was rotated opposite of the standard direction and water was pumped from the vacuum vessel through the normal Moyno™ discharge port through the pump and out from the feed opening. From the pump, the water flowed through a one liter sealed surge tank, through a fine filter, through the discharge rotometer and into the coating die. The inlet flow rate was manually adjusted by a flow throttling valve at the inlet rotometer inlet. The vacuum vessel water discharge flow rate was controlled by the speed of rotation of the Moyno™ pump and monitored by the discharge rotometer. During operation the inlet flow rate was manually adjusted with the throttling valve to match the indicated discharge rate. The filter used was a disposable filter capsule. This was purchased from the Porous Media Corporation of St. Paul, Minn., and it was identified as part number DFC1022Y050Y, rated for 5 microns. Vacuum to the degassing vessel was supplied by a water ring vacuum pump, model MHC-25 from the Nash Engineering Corporation of Downers Grove, Ill. The carrier water flow rate was 2910 ml/min.

The coating fluid was supplied from a 60 ml syringe driven by a syringe pump at a rate of 0.2 ml/min. The pump was a Harvard model 44, programmable syringe pump number 55-1144T as sold by the Harvard Apparatus Corporation of South Natick, Mass.

During coating, the slide curtain coating die was positioned above coating station roll 58 (referring to FIG. 1). More specifically, it was located so that the curtain height, h, was 42 mm and the curtain impinged on the web on the roll at an angular position 310° measured clockwise from the top of the roll. The impingement angle, a, was approximately 50°. This angle is measured between the curtain and a line tangent to the web surface at the point of contact of the curtain and the web. The die face 40 was inclined at an angle of 85° from the horizontal. The coating fluid slot width was 18.5 cm while the carrier fluid slot width was 21 cm. The distributing slot gaps for the coating fluid and the carrier water were 152 and 762 microns respectively. The diameter of the coating roll 58 was 2.5 cm.

Coatings were applied to the web at speeds of 45 and 73 cm/sec. The carrier fluid was simultaneously drained by gravity and blown off with an air knife. The air knife nozzle gap was 152 microns and the nozzle pressure was 140 Kpa. No edge guides were used, and the width of the composite curtain at the contact point was wider than the web.

When the coating fluid is distributed uniformly across the web as in this method, the coating caliper may be calculated from the coated width, the web speed and the coating fluid flow per unit width of slot. At the indicated speeds of 45 and 73 cm/sec, the coated calipers were calculated to be 400 and 250 Å respectively. Visual inspection of the coatings indicated that the coatings were void free and uniform.

EXAMPLE 2

Ultra-thin Coating of an Immiscible Fluid

Using the slide curtain coater die, and the coating fluid and the carrier fluid deliver systems described in Example 1, ultra-thin coatings of a polyglycol base coating fluid were produced. The coating formulation consisted of the following weight %:90% polypropylene glycol, 9% of an epoxy functional silicone fluid, and 1% of a saturated solution in toluene of fluorescent Yellow G dye.

The polypropylene glycol had an average molecular weight of 4000, is available from the Dow Chemical Company, Midland, Mich., under the designation P4000. The epoxy functional silicone is available form the General Electric Company, Waterford, N.Y., under the designation GE9300. The toluene dye solution was prepared by saturating the solvent with an excess of Yellow G dye. The saturated solution was collected by decanting the liquid solution after allowing the excess dye particles to settle to the bottom of the mixing vessel. The Yellow G dye is a product of the Keystone-Ingham Corporation of Mirada, Calif. This coating fluid had a viscosity of 302 cp at 22° C. The surface tension and density were 25 dyne/cm and 0.98 gm/cm$^3$.

In this example, the die was relocated to a position above roll 58 where the curtain height was 22 mm; the die face angle was 75°; and the impingement angle was 45°. Coating was first accomplished with a coating fluid flow rate of 0.1 ml/min from a die slot 20 cm wide and at a web speed of 100 cm/sec. In case B, the coating fluid flow rate was 1 ml/min and the web speed 15 cm/sec. The water carrier fluid flow was 3300 ml/min from a slot 26 cm wide. Air nozzle pressure, web, web width, and apparatus were identical to Example 1.

In case A, the coating caliper was calculated as 89 Å, and in case B the caliper was 5900 Å. Case A is an ultra-thin coating and case B is much thicker and is referred to as a thin coating. This example illustrates the ability of the method of this invention to coat a very wide range of thicknesses. An effort was made to quantify the uniformity of these coating by measuring the fluorescence from the Yellow G dye in the coated samples. A photometric analyzer was used to measure the fluorescent emissions at a wavelength of 500 nanometers when excited with a wavelength of 440 nanometers. The fluorescence of 7 mm diameter spots taken at random locations across and down the web was measured. The uncoated web was also measured giving an average fluorescence of 2.06 relative units with a standard deviation of 0.05. In case A, the average fluorescence was 2.40 units with a standard deviation of 0.03. In case B, the average fluorescence was 24.86 units with a standard deviation of 1.41. The samples were completely coated with no voids present, and these fluorescence readings indicated good uniformity. The fluorescence of the dye in the coatings is proportional to the coating thickness. The measured change in the base corrected fluorescence from case A to case B is a factor of 67. This agrees closely with the coating thickness change from case A to case B of 66 based on the web speeds and coating fluid flow rates.

EXAMPLE 3

Coating a Fluid Miscible with the Carrier Fluid

Using the slide curtain coating die shown in FIG. 1, an ultra-thin coating of a water soluble resin solution was applied to a polyester web. The coating fluid consisted of a solution of Carbolpol® 940 resin dissolved in tap water. This solution was prepared by first dissolving approximately 1.1 weight % of the resin in water and then neutralizing the solution to a pH of 7 with a 5 weight % sodium hydroxide solution. This created a viscous gel to which a saturated solution of Solvent Green 7 dye was added at a ratio of one part of dye per 100 parts of gel. The gel was then diluted with water until a viscosity of 300 cp was obtained when measured at 60 rpm with spindle LV#4 on a Brookfield model LVTDV-II viscometer. To the diluted solution 0.2 gm of Silwet® 7200 surfactant per 100 gm of solution was added. The surface tension of the resin solution was 23.5 dyne/cm, and it was completely miscible with the tap water used as the carrier fluid during coating. The interfacial tension between the coating fluid and the carrier fluid was zero because of the miscibility.

The Carbolpol® is available from the B.F. Goodrich Company of Cleveland, Ohio. The Solvent Green 7 dye is available from Keystone-Ingham Corporation of Mirada, Calif. The Brookfield viscometer is a product of the Brookfield Engineering Laboratories, Inc. of Stoughton, Mass. The Silwet® surfactant is manufactured by the Union Carbide Chemicals and Plastics Company, Inc. of Danbury, Conn.

The polyester web, the carrier supply apparatus, and the coating die were the same as used in Example 1. The carrier fluid used was tap water from the municipal water supply without any surface tension modifying additives. The water was supplied at a temperature of 13° C. to a vacuum degassing vessel operated at pressure of 200 mm of Hg absolute and then pumped to the coating die. The rate of supply was 3000 ml/min. The carrier fluid viscosity was estimated at 1.2 cp.

During coating, the slide curtain coating die was positioned above coating station roll 58 (referring to FIG. 1). More specifically, it was located so that the curtain height, h, was 3 mm and the impingement angle, a, was approximately 45°. The die face 40 was inclined at an angle of 84° from the horizontal. The coating fluid slot width was 18.5 cm while the carrier fluid slot width was 21 cm. The distributing slot gaps for the coating fluid and the carrier water were 160 and 1100 microns respectively. The diameter of the coating roll 58 was 2.5 cm.

The carrier fluid was simultaneously drained by gravity and blown off with an air knife. The air knife nozzle gap was 250 microns and the compressed air was supplied to it at a pressure of 70 Kpa.

The coating fluid was supplied from a 600 ml syringe driven by a syringe pump to supply fluid at rates of 11, 21.5, 50, and 100 gm/min. The web speed was held constant at 29 cm/sec. Fluorescence of the undried coated samples was measured at 0.8, 1.4, 2.4, and 5.0 relative fluorescence units for the four coating fluid pumping rates respectively. The coat weights as indicated by the fluorescence varied linearly with coating fluid pumping rate. This example again illustrates that coating weight directly responds to coating fluid pumping rate. The example also demonstrates that miscible coating and carrier fluid combinations may be successfully used.

EXAMPLE 4

Coating of Immiscible Fluid with a Jet Coating Apparatus

Using the jet coating die shown in FIG. 2, a thin coating of a UV light curing solution was applied to a polyester web.

A syrup was prepared by mixing 90 pans isooctyl acrylate with 10 parts acrylic acid and 0.04 pans of benzil dimethyl ketal (Irgacure™651 from Ciba Geigy). The mixture sparged with nitrogen, and partially polymerized to a syrup having a viscosity of about 3000 centipoise by exposure to ultraviolet fluorescent lamps. An additional 0.15 part of benzil dimethyl ketal was added to the syrup. The UV light curing solution was prepared by mixing 66.9 grams of the resulting syrup with 220 grams of isooctyl acrylate.

To this was added one part by weight of the Yellow G dye solution described in Example 2 for every 20 parts of solution. Also added was Silwet® 7200 surfactant in proportions of one part per 2000 parts of solution by weight. A viscosity of 700 cp was obtained when measured at 60 rpm with a number 4 spindle on a Brookfield model LVTDV-II viscometer for this formulation.

The polyester web, the coating fluid supply apparatus, and the carrier supply apparatus were the same as used in Example 1. The carrier fluid used was tap water from the municipal water supply without any surface tension modifying additives. The water was supplied at a temperature of 12° C. to a vacuum degassing vessel operated at pressure of 200 mm of Hg absolute and then pumped to the coating die. The rate of supply was 4100 ml/min. The carrier fluid viscosity was estimated at 1.2 cp.

During coating, the jet coating die was positioned above coating station roll 56 as illustrated in FIG. 2 with the carrier fluid slot 64 orientated horizontally. The web translated vertically downward past the die at a horizontal spacing of 3.7 cm. The composite jet of carrier fluid and coating fluid was bent downward by gravity and impinged on the web at an acute angle. No edge guides were used and the composite jet contracted to a width of 10 cm at the contact point with the web. The coating fluid slot width was 18.5 cm while the carrier fluid slot width was 21 cm. The distributing slot gaps for the coating fluid and the carrier water were 150 and 280 microns respectively.

The carrier fluid was simultaneously drained by gravity and blown off with an air knife. The air knife nozzle gap was 250 microns and the compressed air was supplied to it at a pressure of 210 Kpa.

The coating fluid was supplied at rates of 2, 4, and 8 ml/min. The web speed was held constant at 29 cm/sec. The solution of polymer and monomers was polymerized by the application of UV light to form a gel. Fluorescence of the gelled, coated samples was measured at 0.8, 1.4, 2.4, and 5.0 relative fluorescence units for the four coating fluid pumping rates respectively. The coat weights as indicated by the fluorescence varied linearly with coating fluid pumping rate. The calculated coating calipers were 10000, 21000, and 43000 Å. This example again illustrates that coating weight directly responds to coating fluid pumping rate. The example also demonstrates that immiscible coating fluid and carrier fluid combinations may be successfully used with the coating method to achieve coating calipers of tens of thousands of Angstroms.

EXAMPLE 5

Release Coating Prepared from a Fluoropolymer

Using the slide curtain coating die shown in FIG. 1, an ultra-thin coating of a fluoropolymer UV polymerizable fluid was applied to a polyester web. The coating fluid consisted of an acrylic functional perfluoropolyether as described in U.S. Pat. No. 4,472,480 (Compound II).

The polyester web, the carrier supply apparatus, the coating supply apparatus, and the coating die were the same as used in Example 1. The carrier fluid used was tap water from the municipal water supply without any surface tension modifying additives. The water was supplied at a temperature of 7° C. to a vacuum degassing vessel operated at pressure of 200 mm of Hg absolute and then pumped to the coating die. The carrier fluid viscosity was estimated at 1.4 cp.

The viscosity of the coating fluid was 40 cp. The surface tension of the coating fluid was 19 dyne/cm, and the density was 1.7 gm/cm$^3$. All these properties were measured at 23° C.

In this example, the die was relocated to a position above roll 58 where the curtain height ranged from 68 to 84 mm; the die face angle was 75°; and the impingement angle was 35° to 45°. The carrier fluid die slot width was 25 cm and the gap was 0.76 mm. The coating fluid die slot width was 25 cm and the gap was 0.165 mm. Air nozzle velocity and apparatus were identical to Example 1. Table 1 gives the carrier and coating fluid flow rates, web speeds, and UV curing dosages used in preparing the samples. Calculated coating caliper and measured resulting release values are also given. Release performance of the coated samples was measured against a commercially available silicone pressure-sensitive adhesive (DC 355, available from the Dow Corning Corporation of Midland, Mich.). The adhesive was coated directly onto the ultra-thin fluorochemical layer at a web coating thickness of 200 microns, and the solvent was allowed to dry overnight at room temperature. A 50 micron sheet of polyester film was laminated to the dried adhesive layer, and this polyester sheet, along with the adhesive, was aged 72 hours at room temperature, was then peeled from the fluorochemical coating at a peel angle of 180° and a rate of 3.8 cm/sec.

TABLE 1

| SAMPLE # | Carrier Flow (ml/min) | Coat Flow (ml/min) | Web Speed (cm/sec) | Caliper (Å) | 360 nm UV Dosage (millijoules/cm$^2$) | Release value (gm/2.5 cm) |
|---|---|---|---|---|---|---|
| a36 | 2400 | 0.200 | 102 | 216 | 50 | 76 |
| a44 | 2400 | 0.300 | 106 | 310 | 48 | 3 |

It can be seen functional release coatings are obtained, as compared to uncoated web where the release value exceeds 1500 gm/2.5 cm.

EXAMPLE 6

Release Coating Prepared from a Thermal Cured Silicone

Using the slide curtain coating die shown in FIG. 1, an ultra-thin coating of a thermally polymerizable silicone fluid was applied to polyester and paper web. The coating fluid consisted of a thermal cured solventless silicone as described in U.S. Pat. No. 4,504,645 (Example 1, Sample 1). The paper web was a 60 pound natural super calendared kraft paper supplied by Nicollet Paper Company, Depere, Wis.

The carrier supply apparatus, the polyester, the coating supply apparatus and the coating die were the same as used in Example 1. The carrier fluid used was tap water from the municipal water supply without any surface tension modifying additives. The water was supplied at a temperature of 8° C. to a vacuum degassing vessel operated at pressure of 200 mm of Hg absolute and then pumped to the coating die. The carrier fluid viscosity was estimated at 1.3 cp.

The viscosity of the coating fluid was 257 cp. The density was 0.97 gm/cm$^3$, and the surface tension was 20.7 dyne/cm. All these properties were measured at 23° C.

In this example, the die was relocated to a position above roll 58; the die face angle was 75°; and the impingement angle was 45°. Air nozzle pressure was 140 Kpa and the nozzle slot gap was 0.25 min. The coating fluid slot width was 23 cm while the carrier fluid slot width was 25 cm. The distributing slot gaps for the coating fluid and the carrier water were 150 and 760 microns, respectively.

Table 2 gives the coating fluid flow rates, calculated coating caliper, and measured release values of the samples prepared. In all cases the curtain height was 34 mm; the web speed was 25 cm/sec; the carrier fluid flow rate was 3000 ml/min. Coated samples were cured in an oven at 150° C. for two minutes. Release values were measured by laminating a 2.54 cm wide strip of Scotch™ 610 adhesive tape to the silicone coating using a 2 kg roller. After 24 hours, the tape was peeled from the silicone coating at a 180° angle and at a rate of 3.8 cm/sec.

TABLE 2

| SAMPLE # | WEB # | Coating Flow (ml/min) | Coating Caliper (Å) | Release (gm/2.54 cm) |
|---|---|---|---|---|
| b1 | polyester | 0.38 | 997 | 295 |
| b2 | polyester | 0.38 | 997 | 103 |
| b3 | polyester | 1.75 | 4600 | 26 |
| b4 | polyester | 1.75 | 4600 | 27 |
| b5 | paper | 1.75 | 4600 | 27 |
| b6 | paper | 1.75 | 4600 | 34 |

EXAMPLE 7

Release Coating Prepared from a UV Cured Silicone

Using the slide curtain coating die shown in FIG. 1, ultra-thin coatings of a UV polymerizable epoxysilicone fluid, as described in Example 3 of U.S. Pat. No. 5,332,797, were applied to a polyester web. The coating fluid was a mixture of 95 parts of epoxysilicone with an epoxy equivalent weight of 538, 2 parts of bis(dodecylphenyl)iodonium hexafluoroantimonate, 3 parts of Alfol® 1012 HA (a mixture of alkyl alcohols), and 0.2 parts of 2-isopropylthioxanthone.

The carrier supply apparatus, the polyester web, the coating supply apparatus, and the coating die were the same as used in Example 1. The carrier fluid used was tap water from the municipal water supply without any surface tension modifying additives. The water was supplied at a temperature of 16° C. to a vacuum degassing vessel operated at pressure of 200 mm of Hg absolute and then pumped to the coating die. The carrier fluid viscosity was estimated at 1.1 cp.

The viscosity of the coating fluid was 276 cp. The surface tension of the coating fluid was 23 dyne/cm, and the density was 1.01 gm/cm$^3$. All these properties were measured at 23° C.

All coatings were prepared at a line speed of 25 cm/sec and then passed at the same speed under a single medium pressure mercury lamp running at 60 watts per cm to give a cured, tack free release coating. Various coating weights were applied by changing the pumping rate of the coating fluid, and the results are given in Table 3. Release values of the coatings were measured by coating an acrylic pressure-sensitive adhesive, i.e., a 95.5:4.5 isooctyl acrylateacrylic acid copolymer as described in U.S. Pat. No. Re. 24,906, directly onto the release coating using heptane as solvent. After coating, the adhesive was dried in an oven at 70° C. for 5 minutes, and a 50 micron thick polyester film was laminated to the adhesive layer. This laminate was heated in an oven at 70° C. for 72 hours. The aged laminate was cut into 2.5×25 cm strips and attached, substrate side down, to a glass plate using double stick tape. The release value is the force, in grams, required to pull the polyester film with the pressure-sensitive adhesive adhered thereto, away from the release coated substrate at an angle of 180° and a pulling rate of 230 cm/min.

TABLE 3

| Caliper | Release Initial | Release Aged | Readhesion (oz/2.54 cm) | |
|---|---|---|---|---|
| (Å) | (gm/2.54 cm) | (gm/2.54 cm) | Initial | Aged |
| 250 | 61 | 294 | 63 | 57 |
| 500 | 89 | 73 | 59 | 60 |
| 1000 | 86 | 63 | 62 | 63 |
| 1500 | 86 | 58 | 62 | 64 |
| 2000 | 80 | 52 | 65 | 63 |
| 2500 | 77 | 59 | 66 | 66 |
| 3000 | 73 | 64 | 67 | 69 |
| 7000* | 64 | 50 | 66 | 62 |

*5-Roll coated sample for reference
"Initial" values 3 day/room temperature dwell of the adhesive on the liner.
"Aged" values are 3 days/158 F. dwell of the adhesive on the liner.

EXAMPLE 8

UV Cured Epoxy Coating

Using the slide curtain coating die shown in FIG. 1, a thin coating of a UV polymerizable epoxy resin fluid was applied to a polyester web. The coating fluid was a solventless resin mixture of 50% ERL 4221 and 50% UVR6379 to which was added an additional 1% by weight of Silwet™ 7500 surfactant and 3% by weight of UVI 6971 photoinitiator all supplied by the Union Carbide Corporation, New York, N.Y.

The polyester web, the coating fluid supply apparatus, and the carrier supply apparatus were the same as used in Example 1. The carrier fluid used was tap water from the municipal water supply without any surface tension modifying additives. The water was supplied at a temperature of 8° C. to a vacuum degassing vessel operated at pressure of 200 mm of Hg absolute and then pumped to the coating die. The carrier fluid viscosity was estimated at 1.3 cp.

The viscosity of the coating fluid was 352 cp. The surface tension of the coating fluid was 27 dyne/cm, and the density was 1.11 gm/cm$^3$. All these properties were measured at 23° C. When coating this material there was observed a great tendency to trap air between the coat fluid and the web surface. This could be eliminated by applying a high voltage potential to the coating roll.

In this example, the die was relocated to a position over roll 58 where the curtain height was 5 mm; the die face angle was 75°; and the impingement angle was 45°. Air nozzle pressure was 140 Kpa and the nozzle slot gap was 0.25 mm. The coating fluid slot width was 23 cm while the carrier fluid slot width was 25 cm. The distributing slot gaps for the coating fluid and the carrier water were 150 and 760 microns respectively.

Table 4 gives the carrier and coating fluid flow rates, electrostatic potential, and web speeds used in preparing the samples. Calculated coating caliper is also given. The coatings were cured by passing them under a single medium pressure mercury lamp mounted in line with the coating apparatus. The coat appeared uniform, fully cured and defect free upon visual inspection.

TABLE 4

| SAMPLE # | Carrier flow (ml/min) | Coat flow (ml/min) | Web speed (cm/sec) | Caliper (Å) | Coating Roll potential (volts) | UV Dosage (millijoules/ sq cm) |
|---|---|---|---|---|---|---|
| c1 | 2080 | 2.0 | 7.62 | 17500 | 700 | 400 |
| c2 | 2080 | 6.0 | 6.60 | 60000 | 800 | 462 |

EXAMPLE 9

Release Coating Prepared from a Miscible Latex Silicone Release Agent

Using the slide curtain coating die shown in FIG. 1, a thin coating of a water miscible latex silicone release agent was applied to a polyester web. The coating fluid was a water based latex, thermal curing resin mixture from GE Silicones of Waterford, N.Y. consisting of 10 parts of latex SM2145 and 1 part of latex SM2146c. For samples a and b, the undiluted mix was coated at a viscosity of 284 cp measured by Brookfield viscometer at 60 rpm with LV#2 spindle. For samples c and d, the mix was diluted with water at the ratio of 10 parts of water to 1 part of latex mix then the thickening agent Natrosol 250HR was added to give a viscosity of 2300 cp by Brookfield at 60 rpm with LV#3 spindle. The thickener is manufactured by the Hercules, Inc. of Wilmington, Del. The surface tension and density of the mixed latex before dilution were 27 dyne/cm and 0.98 gm/cm$^3$. The interfacial tension between the latex mix and the carrier water was zero; the latex was miscible with the carrier water.

The carrier supply apparatus, the polyester web, the coating supply apparatus, and the coating die were the same as used in Example 1. The carrier fluid used was tap water from the municipal water supply without any surface tension modifying additives. The water was supplied at a temperature of 9° C. to a vacuum degassing vessel operated at pressure of 200 mm of Hg absolute and then pumped to the coating die. The carrier fluid viscosity was estimated at 1.3 cp. The carrier water supply apparatus was as described in Example 1.

In this example, the die was located above roll 58 where the curtain height was 10 mm; the die face angle was 75°; and the impingement angle was approximately 45°. The air nozzle slot gap was 0.25 mm. Table 5 gives the calculated silicone caliper, web speeds, and air nozzle pressures used in preparing the samples along with release results. The coated samples were dried and cured in a batch oven for 10 minutes at 120° C. The coat appeared uniform, fully cured and defect free upon visual inspection.

Release of these coatings was evaluated using Scotch™ 810 Tape. A 2.54 cm wide strip of tape was laminated to the cured coatings and rolled down with a 2 kg roller. Release was measured by peeling the tape back from the silicone coated substrate at a 180° angle at a rate of 228.6 cm/min. The force required to peel the tape was averaged over a 5 second peel and is reported in grams per inch width. A control of base polyester produces a release of 661 gm/2.54 cm.

TABLE 5

| SAMPLE # | Web speed (cm/sec) | Caliper (Å) | Air Nozzle Pressure (Kpa) | Release (gm/ 2.54 cm) |
|---|---|---|---|---|
| a | 14 | 24000 | 70 | 5 |
| b | 54 | 4300 | 140 | 6 |
| c | 65 | 930 | 70 | 102 |
| d | 74 | 400 | 70 | 261 |

EXAMPLE 10

Coating a Miscible Latex Adhesive

In this example, the apparatus of Example 1 was used with the exceptions that first a larger syringe pump was used and second that carrier fluid was continuously recirculated from a 60 liter tank. The vacuum degassing tank 36 in FIG. 1 was replaced by this holding tank which was physically located so that the fluid from receptacle 50 could be drained by gravity into it thus allowing recirculation of the carrier.

Thin coatings of a water miscible, 45% solids, latex adhesive was applied to polyester web. The latex was a Sequabond DW-1 purchased from the Sequa Chemicals, Inc. of Chester, S.C. Its viscosity was measured as 28,600 cp on a Brookfield viscometer with spindle #LV2 at 0.3 rpm at 21.7° C. The surface tension of the coating fluid was 39.4 dyne/cm, and the density was 1.0 gm/cm$^3$. All these properties were measured at 21° C.

The carrier fluid used was tap water from the municipal water supply without any surface tension modifying additives. The water was supplied to the tank 36 and allowed to warm to 21° C. before use. During coating, ribbons of polyethylene film were placed on top of the web at each web edge. These extended from 2.2 cm in from the edge of the web outward to the edge of the coating die. They were to prevent adhesive from wetting the coating station roll 58 while leaving an uncoated margin at each edge of the web. Both carrier and coating fluids from the two edge regions were directed into the receptacle 50. There they intermingled with the carrier blown off the web by gas jet 52. One result of this was that the carrier fluid become contaminated with latex coating fluid. The carrier fluid rate was 1000 ml/min, and the viscosity was measured as 1.06 to 1.40 cp. The air nozzle pressure was 20 Kpa. The carrier and coating fluid slot were 25.8 and 25.2 cm in width and had gaps of 0.49 and 0.25 mm respectively.

Table 6 gives the latex mass flow rate and the coating calipers obtained at the web speed of 27 cm/sec, a latex solids fraction of 0.45, and an air nozzle gap to the web in the range of 1 to 2 ml. The coat appeared uniform, functional and defect free upon visual inspection.

TABLE 6

| Latex flow (gm/cm-sec) | Dry Coating Caliper (Å) | Wet Coating Caliper (Å) |
|---|---|---|
| 0.0786 | 160000 | 350000 |
| 0.0302 | 62000 | 138000 |
| 0.0196 | 46000 | 102000 |
| 0.0151 | 38000 | 84000 |
| 0.0060 | 15000 | 33000 |
| 0.0030 | 8000 | 17000 |
| 0.24 | 470000 | 1040000 |

EXAMPLE 11

Release Coating Prepared From a Solvent Solution

Using the slide curtain coating die shown in FIG. 1, an ultra-thin coating of a urethane release coating was applied to the corona treated side of a 25 micron caliper biaxially orientated a polypropylene web.

The coating fluid was a solution of 1.1% tagged urethane polymer in a solvent consisting of 1 part of toluene, 1 part of tetradecane, and 2 parts of xylol. The fluorescent agent tagged urethane release polymer was prepared as in U.S. Pat. No. 4,978,731 (Example 2) with the exception that the solvent blend recited above was used. The viscosity of the coating fluid was estimated as 0.7 cp. The surface tension of the coating fluid was 25 dyne/cm, and the density was 0.9 gm/cm$^3$. All these properties were measured at 24° C. Various coating weights were applied by changing the web speed while maintaining the pumping rate of the syringe pump of Example 1 dispensing the coating fluid at 5 ml/min from a 14 cm wide slot. Carrier water flow rate was 2800 ml/min, and the curtain heights ranged from 3 to 16 mm.

The carrier fluid used was tap water from the municipal water supply without any surface tension modifying additives. The water was supplied at a temperature of 27° C. to a vacuum degassing vessel operated at pressure of 200 mm of Hg absolute and then pumped to the coating die. The carrier fluid viscosity was estimated at 1 cp. The carrier water supply apparatus was as described in Example 1.

Fluorescence measurements indicated complete coverage and dried coating weights that were proportional to web speed. Release values are given in Table 7. Release performance was evaluated by laminating a 2.54 cm wide strip of Scotch™ 810 Magic Tape, purchased from Minnesota Mining and Manufacturing Company, St. Paul, Minn., to the dried coatings using a 2 kg roller. The tape strips were then peeled from the ultra-thin coatings at an angle of 180° and a peel rate of 3.8 cm/sec.

TABLE 7

| Caliper (Å) | Release (gm/in) |
|---|---|
| 64 | 320 |
| 128 | 280 |
| 257 | 310 |
| 758 | 190 |
| uncoated film | 495 |

EXAMPLE 12

Coating with a Non-Aqueous, High-Viscosity Carrier Fluid

Using the slide curtain coating die shown in FIG. 1, an ultra-thin coating of a epoxy-silicone resin solution was applied to a polyester web. The coating fluid consisted of 35% solution of epoxysilicone fluid described in Example 7 dissolved in the solvent nonane. Its viscosity was 9 cp, and the surface tension of the resin solution was 24 dyne/cm. The coating density was 1.0 gm/cm$^3$. The carrier fluid was Dowtherm™ SR-1, ethylene glycol heat transfer fluid, from the Dow Chemical Company of Midland, Mich. Its viscosity was 18 cp, and the surface tension was 34 dyne/cm. The carrier density was 1.14 gm/cm$^3$. The carrier fluid was supplied from a tank at a temperature of 22° C. and pumped to the coating die using a gear pump. The rate of supply was 2700 ml/min. The polyester web was the same as used in Example 1.

The polyester web, the coating fluid supply apparatus and coating die were the same as used in Example 1. During coating, the slide curtain coating die was positioned above coating station roll 57 as in Example 3 with a the curtain height of 7 mm. The impingement angle was approximately 45°. The coating fluid slot width was 24 cm while the carrier fluid slot width was 25 cm. The distributing slot gaps for the coating fluid and the carrier fluid were 160 and 800 microns respectively. The carrier fluid was simultaneously drained by gravity and blown off with an air knife. The air knife nozzle gap was 250 microns and the compressed air was supplied to it at a pressure of 200 Kpa. Residual droplets of glycol were washed from the surface of samples obtained with water.

The coating fluid was supplied from a 60 ml syringe driven by a syringe pump to supply fluid at a rate of 0.5 gm/min. The web speed was held constant at 19 cm/sec. Continuous coatings were observed in the samples. The calculated wet caliper for these conditions was approximately 1700 Å. This example demonstrates that immiscible coating fluid and carrier fluid combinations may be used where the carrier is not water. It demonstrates the use of a carrier of higher viscosity than the coating fluid.

Many variations of the described systems can be used. For example, the flowing layer of carrier fluid need not be formed flowing from a slot of a die. It can be formed from the flow over a weir or an open trough. Also, the composite layer need not be formed on the die. The coating fluid can be deposited on the carrier fluid after it leaves the die lip. Also, a multiple layer carrier fluid and a multiple layer coating fluid can be used. A multiple layer carrier fluid could have a pure upper layer and a recycled lower layer.

We claim:

1. A method of coating a substrate with a layer comprising the steps of:

moving the substrate along a path through a coating station;

forming a composite layer comprising at least one coating fluid and at least one carrier fluid having a formulation different from that of each coating fluid, wherein the carrier fluid comprises a liquid at the ambient condition at the coating station;

flowing the carrier fluid at a rate that, by itself, is sufficient to form a continuous flowing fluid bridge of composite layer to the substrate for the coating width, wherein the carrier fluid is continuous;

contacting the substrate with the flowing composite layer to interpose the coating layer between the substrate and the carrier fluid; and removing carrier fluid while leaving the coating fluid deposited on the substrate as a coating layer, wherein none of the components of the carrier fluid is part of the coating and at least a portion of all of any carrier fluid components are removed, thereby permitting the carrier fluid to act as a type of transfer device.

2. The method of claim 1 wherein the forming step comprises forming a carrier fluid that is a mixture of a plurality of molecular species wherein each molecular species is a liquid at the ambient condition at the coating station.

3. The method of claim 1 wherein the forming step comprises forming a carrier fluid of water.

4. A method of coating a substrate with a layer comprising the steps of:

moving the substrate along a path through a coating station;

forming a composite layer comprising at least one coating fluid and at least one carrier fluid having a formulation different from that of each coating fluid;

flowing the composite layer at a rate that is sufficient to form a continuous flowing fluid bridge of composite layer to the substrate for the coating width, wherein the carrier fluid portion of the composite layer is continuous;

contacting the substrate with the flowing composite layer to interpose the coating layer between the substrate and the carrier fluid; and removing at least a portion of the carrier fluid while leaving the coating fluid deposited on the substrate as a coating layer comprising at least one of mechanical doctoring, draining by gravity, centrifugal removal blowing, and suction, solidification of carrier followed by doctoring, magnetic attraction, gelation of the carrier then doctoring, gelation of the coating then doctoring, solidification of the coating then doctoring, adsorption of the carrier fluid, and chemical bonding of the coating followed by mechanical removal of carrier.

5. The method of claim 4 wherein the flowing step comprises flowing the composite layer at a rate that is sufficient to form a continuous flowing fluid bridge of composite layer to the substrate for the coating width, without being sufficient to form a continuous flowing fluid bridge of only the coating fluid.

6. The method of claim 4 wherein the coating deposited on the substrate has a thickness that is less than 50 microns.

7. The method of claim 6 wherein the coating deposited on the substrate has a thickness that is less than 5 microns.

8. The method of claim 4 wherein the moving step comprises moving the substrate through the coating station at speeds of up to 2000 m/min.

9. The method of claim 4 wherein the forming a composite layer step comprises continuously metering the respective fluids through respective orifices.

10. The method of claim 4 wherein the coating comprises precursors of functional release coatings.

11. The method of claim 4 further comprising the step of selecting a carrier fluid that is not miscible with the coating, that has a lower viscosity than the coating, and that has surface tension greater than the coating.

12. The method of claim 4 wherein the forming a composite layer step comprises using carrier fluid that is immiscible with the coating fluid with which it forms an interface and wherein the carrier fluid has wetting properties that cause it to remain as a continuous film covering the surface of the coating fluid-coated substrate.

13. The method of claim 12 further comprising the step of depositing on the substrate the coating fluid at wet calipers larger than 10000 angstroms.

14. The method of claim 4 wherein the forming a composite layer step comprises using carrier fluid that is miscible with the coating fluid with which it forms an interface.

15. The method of claim 14 further comprising the step of depositing on the substrate the coating fluid at wet calipers larger than 10000 angstroms.

16. The method of claim 15 wherein the forming a composite layer step comprises preventing the carrier fluid from remaining as a continuous film covering the surface of the coating fluid-coated substrate after the deposition step and after the doctoring step while the substrate is in the coating station.

17. A method of coating a substrate with a layer comprising the steps of:

moving the substrate along a path through a coating station;

forming a composite layer comprising at least one coating fluid and at least one carrier fluid having a formulation different from that of each coating fluid;

flowing the composite layer at a rate that is sufficient to form a continuous flowing fluid bridge of composite layer to a transfer surface for the coating width, wherein the carrier fluid portion of the composite layer is continuous;

contacting the transfer surface with the flowing composite layer to interpose the coating layer between the transfer surface and the carrier fluid;

removing carrier fluid while leaving the coating fluid deposited on the transfer surface as a coating layer; and transferring some portion of the coating fluid to the substrate from the transfer surface.

18. A method of coating a substrate with a layer comprising the steps of:

moving the substrate along a path through a coating station;

forming a composite layer comprising at least one coating fluid and at least one carrier fluid having a formulation different from that of each coating fluid using carrier fluid that is immiscible with the coating fluid with which it forms an interface and wherein the carrier fluid has wetting properties that cause it to not wet the surface of the coating fluid-coated substrate;

flowing the composite layer at a rate that is sufficient to form a continuous flowing fluid bridge of composite layer to the substrate for the coating width, wherein the carrier fluid portion of the composite layer is continuous;

contacting the substrate with the flowing composite layer to interpose the coating layer between the substrate and the carrier fluid; and removing at least a portion of the carrier fluid while leaving the coating fluid deposited on the substrate as a coating layer.

19. A method of coating a substrate with a layer comprising the steps of:

moving the substrate along a path through a coating station;

forming a composite layer comprising at least one coating fluid and at least one carrier fluid having a formulation different from that of each coating fluid using carrier fluid that is immiscible with the coating fluid with which it forms an interface and wherein the carrier fluid has wetting properties that cause it to not wet the surface of the coating fluid-coated substrate;

flowing the composite layer at a rate that is sufficient to form a continuous flowing fluid bridge of composite layer to the substrate for the coating width, wherein the carrier fluid portion of the composite layer is continuous;

contacting the substrate with the flowing composite layer to interpose the coating layer between the substrate and the carrier fluid; and removing at least a portion of the carrier fluid while leaving the coating fluid deposited on the substrate as a coating layer; and depositing on the substrate the coating fluid at wet calipers between 50 and 10000 angstroms.

20. A method of coating a substrate with a layer comprising the steps of:

moving the substrate along a path through a coating station;

forming a composite layer comprising at least one coating fluid and at least one carrier fluid having a formulation different from that of each coating fluid;

flowing the composite layer at a rate that is sufficient to form a continuous flowing fluid bridge of composite layer to the substrate for the coating width, wherein the carrier fluid portion of the composite layer is continuous;

contacting the substrate with the flowing composite layer to interpose the coating layer between the substrate and the carrier fluid; and removing carrier fluid while leaving the coating fluid deposited on the substrate as a coating layer, wherein the removing the carrier fluid step comprises at least one of removing the carrier fluid without drying the carrier fluid and removing the carrier fluid without blowing off with a gas knife.

21. A method of coating a substrate with a layer comprising the steps of:

moving the substrate along a path through a coating station;

forming a composite layer comprising at least one coating fluid and at least one carrier fluid having a formulation different from that of each coating fluid;

flowing the composite layer at a rate that is sufficient to form a continuous flowing fluid bridge of composite layer to the substrate for the coating width, wherein the carrier fluid portion of the composite layer is continuous;

contacting the substrate with the flowing composite layer to interpose the coating layer between the substrate and the carrier fluid; and removing carrier fluid while leaving the coating fluid deposited on the substrate as a coating layer, wherein the removing the carrier fluid step comprises at least one of removing the carrier fluid after solidifying or gelling of the carrier fluid, and removing the carrier fluid after gelling, solidifying or chemically reacting the coating fluid.

22. An apparatus for coating a substrate with an ultra-thin layer comprising:

a die for ejecting a carrier fluid;

means for depositing at least one coating fluid onto the carrier fluid, wherein the carrier fluid has a formulation different from that of each coating fluid, and the carrier fluid is a liquid at the ambient condition at the coating station, to create a plurality of flowing layers of fluid in face-to-face contact with each other to form a composite layer;

means for moving the substrate at a spaced distance from the die to permit the composite layer to form a continuous flowing fluid bridge to the substrate surface for the coating width and to deposit the coating layer on the substrate; and means for removing carrier fluid while leaving the coating fluid deposited on the substrate as a coating layer, wherein none of the components of the carrier fluid is part of the coating and at least a portion of all of any carrier fluid components are removed, thereby permitting the carrier fluid to act as a type of transfer device.

23. An apparatus for coating a substrate with an ultra-thin layer comprising:

a die for electing a carrier fluid, wherein the die has a face, a slot communicating with the face, and a lip wherein the carrier fluid exits from the slot onto the face and flows along the face to the lip;

means for depositing at least one coating fluid onto the carrier fluid, wherein the carrier fluid has a formulation different from that of each coating fluid to create a plurality of flowing layers of fluid in face-to-face contact with each other to form a composite layer; wherein the depositing means deposits the coating fluid onto the carrier fluid while the carrier fluid flows along the face, and wherein the composite layer is transported along the die face to the die lip;

means for moving the substrate at a spaced distance from the die to permit the composite layer to form a continuous flowing fluid bridge to the substrate surface for the coating width and to deposit the coating layer on the substrate; and means for removing at least a portion of the carrier fluid while leaving the coating fluid deposited on the substrate as a coating layer; and a transfer surface on which the composite layer is deposited before being deposited on the substrate.

24. An apparatus for coating a substrate with an ultra-thin layer comprising:

a die for electing a carrier fluid;

means for depositing at least one coating fluid onto the carrier fluid, wherein the carrier fluid has a formulation different from that of each coating fluid to create a plurality of flowing layers of fluid in face-to-face contact with each other to form a composite layer;

means for moving the substrate at a spaced distance from the die to permit the composite layer to form a continuous flowing fluid bridge to the substrate surface for the coating width and to deposit the coating layer on the substrate; and means for removing at least a portion of the carrier fluid while leaving the coating fluid deposited on the substrate as a coating layer comprising at least one of a doctor blade, blowing, means for applying centrifugal force, a suction device, draining by gravity, and pulling off by magnetic attraction.

25. The apparatus of claim 24 wherein at least one coating fluid comprises precursors of functional release coatings.

26. The apparatus of claim 24 wherein the carrier fluid is immiscible with the coating fluid with which it forms an interface and wherein the carrier fluid has wetting properties that cause it to not remain as a continuous film covering the surface of the first and second coating fluid-coated substrate.

27. The apparatus of claim 26 wherein the means for moving comprises depositing on the substrate the coating fluid at wet calipers between 50 and 10000 angstroms.

28. The apparatus of claim 24 wherein the carrier fluid is immiscible with the coating fluid with which it forms an interface and wherein the carrier fluid has wetting properties that cause it to remain as a continuous film covering the surface of the first and second coating fluid-coated substrate.

29. The apparatus of claim 28 wherein the means for moving comprises depositing on the substrate the coating fluid at wet calipers larger than 10000 angstroms.

30. The apparatus of claim 24 wherein the carrier fluid is miscible with the coating fluid with which it forms an interface.

31. The apparatus of claim 30 wherein the means for moving comprises depositing on the substrate the coating fluid at wet calipers larger than 10000 angstroms.

32. The apparatus of claim 31 wherein the carrier fluid is prevented from remaining as a continuous film covering the surface of the coating fluid-coated substrate after the deposition step and after the doctoring step while the substrate is in the coating station.

33. An apparatus for coating a substrate with an ultra-thin layer comprising:

a die for electing a carrier fluid;

means for depositing at least one coating fluid onto the carrier fluid, wherein the carrier fluid has a formulation different from that of each coating fluid to create a plurality of flowing layers of fluid in face-to-face contact with each other to form a composite layer;

means for moving the substrate at a spaced distance from the die to permit the composite layer to form a continuous flowing fluid bridge to the substrate surface for the coating width and to deposit the coating layer on the substrate; and means for removing carrier fluid while leaving the coating fluid deposited on the substrate as a coating layer wherein the means for removing carrier fluid comprises at least one of removing the carrier fluid without drying the carrier fluid and removing the carrier fluid without blowing off with a gas knife.

34. An apparatus for coating a substrate with an ultra-thin layer comprising:

a die for ejecting a carrier fluid;

means for depositing at least one coating fluid onto the carrier fluid, wherein the carrier fluid has a formulation different from that of each coating fluid to create a plurality of flowing layers of fluid in face-to-face contact with each other to form a composite layer;

means for moving the substrate at a spaced distance from the die to permit the composite layer to form a continuous flowing fluid bridge to the substrate surface for the coating width and to deposit the coating layer on the substrate; and means for removing carrier fluid while leaving the coating fluid deposited on the substrate as a coating layer wherein the means for removing carrier fluid comprises at least one of removing the carrier fluid after solidifying or gelling of the carrier fluid, and removing the carrier fluid after gelling, solidifying or chemically reacting the coating fluid.

* * * * *

UNITED STATES PATENT AND TRADEMARK OFFICE

CERTIFICATE OF CORRECTION

PATENT NO.: 5,641,544

DATED: June 24, 1997

INVENTOR(S): Kurt C. Melancon, Carl R. Kessel, William K. Leonard

It is certified that error appears in the above-identified patent and that said Letters Patent is hereby corrected as shown below:

Col. 24, Line 38, "electing" should be -- ejecting --.

Signed and Sealed this

Eighteenth Day of May, 1999

*Attest:*

Q. TODD DICKINSON

*Attesting Officer*

*Acting Commissioner of Patents and Trademarks*